United States Patent [19]

Dageförde et al.

[11] 4,158,185

[45] Jun. 12, 1979

[54] OVERHEAD TRANSMISSION LINE WITH COMMUNICATION CORE

[75] Inventors: Hans-Gerd Dageförde, Duisburg; Günter Thönnessen, Monheim, both of Fed. Rep. of Germany

[73] Assignee: AEG-TELEFUNKEN Kabelwerke Aktiengesellschaft, Rheydt, Mönchen-Gladbach, Fed. Rep. of Germany

[21] Appl. No.: 784,791

[22] Filed: Apr. 5, 1977

[30] Foreign Application Priority Data

Apr. 6, 1976 [DE] Fed. Rep. of Germany ..... 2615311

[51] Int. Cl.[2] ..... H01B 11/18

[52] U.S. Cl. ..... 333/243; 174/113 R; 174/128 R; 333/245

[58] Field of Search ..... 333/1, 96; 174/108, 174/115, 113 R, 113 A, 113 AS, 113 C, 128 R, 128 BL; 179/2.5 R, 82; 307/147, 148; 340/18 CM

[56] References Cited

U.S. PATENT DOCUMENTS

| | | | |
|---|---|---|---|
| 3,772,454 | 11/1973 | Donecker et al. | 174/115 X |
| 3,789,130 | 1/1974 | Parker | 175/115 |
| 3,815,054 | 6/1974 | McClure et al. | 174/115 X |
| 3,878,485 | 4/1975 | Erculiani | 333/96 X |

*Primary Examiner*—Paul L. Gensler
*Attorney, Agent, or Firm*—Spencer & Kaye

[57] ABSTRACT

An overhead transmission line composed of a coaxial line element constituted by a central conductor and an insulating sheath concentrically surrounding the central conductor; and a plurality of power current conductors of circular cross section presenting electrically conductive surface portions and disposed around the coaxial element in such a manner that adjacent current conductors contact one another and the insulating sheath, the surface regions of the power conductors which face said sheath together defining a cage-like return conductor enclosing the central conductor.

10 Claims, 3 Drawing Figures

OVERHEAD TRANSMISSION LINE WITH COMMUNICATION CORE

BACKGROUND OF THE INVENTION

The present invention relates to an overhead transmission line of the type provided with a communication core and to an overhead transmission line which has a data transmission line in its interior.

The operation of modern overhead transmission line networks requires fast and dependable data transmission devices in order to be able to handle the heavy and steadily increasing demand for information transmission capacity.

There are known, and still generally used, overhead transmission line networks in which the associated communication devices operate according to the TFH principle, that is with pairs of conductors.

The German symbol "TFH" (Tragerfrequenz auf Hochspannungsleitungen) corresponds to the American symbol "PLC" (power line carrier).

The data is here transmitted along a pair of overhead lines or via one overhead line with earth return. The drawback of this type of data transmission system is that only a very narrow frequency range is available, and this is even more restricted by mutual influence with adjacent overhead line networks. Another drawback in such systems is the transmission energy loss through radiation.

In order to overcome these drawbacks, separate open-air cables have been provided in the overhead transmission line networks for the transmission of data. These cables are either individually suspended in an insulating manner from all poles or towers of the transmission line, as disclosed in German Pat. No. 893,355, or are designed as coaxial cables having a high-voltage resistant insulated inner conductor and a grounded return conductor, as disclosed in German Auslegeschrift [Published Application] No. 19 33 813.

Such a separate overhead cable in an overhead transmission line network has the advantage that a broad frequency range is available for the transmission of data since there is no external influence. Moreover, it is possible to transmit data over a greater distance because no energy is lost along the transmission path. The transmission of data in overhead transmission lines via a separate overhead cable nevertheless has drawbacks since it entails additional technical efforts and costs.

It is also known to accommodate a data conductor concentrically at the interior of a hollow power conductor as disclosed in U.S. Pat. No. 1,855,288. This solution is of course limited to hollow cables, since solid cables do not have such interior space. Aside from that, such cable structure is highly expensive to produce since it is practically necessary to produce a coaxial line with an outer conductor of specially shaped wires. The laying of such phase cables requires comparatively great care and attention since there exists the danger that the hollow cables might develop kinks. Moreover, water may penetrate into the cavity and produce short circuits between the central conductor and the return conductor.

Finally the state of the art also includes a combined carrier frequency and high voltage overhead cable for the transmission of information in power transmission networks. In the center of one of the conductor cables which serves to transmit power there is a single or multiple two-wire plastic insulated carrier frequency line. Such a structure is disclosed in German Pat. No. 2,011,016. This cable has the same advantages, with respect to transmission technique, as those described above for the separate overhead cables. It has, however, the drawback that the outer diameter of the cable is greatly enlarged compared to equivalent cables because the power conductor encloses the data core so that the full power conductor cross section is added to the data core, i.e. this is an overhead communication transmission cable to which has been added the full power conductor cross section. The greater outer diameter of the power conductor results in a substantial increase in the additional loads caused by ice formation and wind forces. A further drawback is that the communication core is too delicate for the sturdy overhead cable so that great care is required in installing the cable. Moreover, the communication core itself is disproportionately heavy, resulting in asymmetrical weight loads on the poles or towers. The known structure of a combined overhead cable is thus suitable only for larger cable cross sections in which the weight and cross-sectional proportion of the data core is relatively small. Finally, the connection of cable sections by means of gripping sleeves produces difficulties.

SUMMARY OF THE INVENTION

It is therefore an object of the present invention to overcome drawbacks of these prior art systems.

It is a more specific object of the present invention to provide an overhead transmission cable with a communication core which is so thin and lightweight that it can also be used in overhead transmission lines of reduced diameter, i.e. so that it can be used also for overhead transmission lines in medium voltage power networks.

These and other objects are achieved according to the invention by the provision of an overhead transmission line composed of a coaxial line element constituted by a central conductor and an insulating sheath concentrically surrounding the conductor; and a plurality of power current conductors of circular cross section presenting electrically conductive surface portions and disposed around the coaxial element in such a manner that adjacent current conductors contact one another and the insulating sheath, the surface regions of the power conductors which face the sheath together defining a cage-like return conductor enclosing the central conductor.

The communications core of the overhead transmission line according to the invention thus comprises a coaxial element of an insulated central conductor without a separate return conductor. Rather, the return conductor is formed by the usual wires of the power conductor directly enclosing the coaxial element. The return conductor thus has a cage-like, star-shaped configuration. The return conductor can also be described as having the form of the surface of a spiral fluted column.

The outer diameter and the weight of the overhead transmission line according to the invention are only insignificantly greater than those of a cable with the same conductor cross section and without a communications core since all elements, the wires as well as the coaxial line element, may have the same diameter.

The coaxial line element may, according to the present invention, be arranged centrally in the interior of the overhead transmission line instead of the core wire, or it may take the place of any desired cable wire. The insulating sheath on the coaxial line element is advisably made of an all-dielectric thermoplastic synthetic material. In order to improve coupling resistance, it may be covered with a conductive layer.

The central conductor of the communication core according to the invention advantageously forms part of the transmission line cross section, i.e., the central conductor is simultaneously utilized for conducting electrical power and for the transmission of data. The overhead transmission line according to the invention may be provided as the pole, or "hot", side of a power phase cable or as the neutral, or ground, side of such cable. The central conductor of the coaxial line element may be short-circuited to the overhead cable with respect to the power alternating current component and may be connected to the associated communication system via isolating capacitors and a decoupling transformer.

The particular advantage of the overhead transmission line according to the present invention is that the incorporation of the communications core produces only a slight addition to the weight and diameter of the line. This is made posible, in particular, because of the multiple utilization of material provided by the present invention. While, in the known combined communication carrier frequency and overhead transmission line cable, the weight may increase by about 68% even for a conductor cross section of 70 $mm^2$, and by several hundred percent for smaller cross sections, the maximum increase in weight in the overhead transmission cable according to the invention with a communication core is only about 22% for a conductor cross section of 16 $mm^2$ and only about 6% for a conductor cross section of 70 $mm^2$.

The cage-like return conductor of the communication core in the overhead transmission line according to the invention has a greater surface area than the return conductors of the known concentric communication lines in overhead transmission line networks. This reduces the skin effect component as well as line attenuation.

The overhead transmission lines according to the invention can be connected very easily. The cables can be pinched, at the installation site, after a thin steel pipe has been inserted over the coaxial line core in the area of the pinch. In this way any desired external radial pressure can be applied.

From a manufacturing point of view the overhead transmission line with communication core poses no problems. It does not require the more complicated devices needed to produce coaxial cables, but can rather be produced on a simple cable machine in which merely one of the cable wires is replaced by a wire or conductor with insulating sheathing.

DESCRIPTION OF THE PREFERRED EMBODIMENTS

Figure 1:
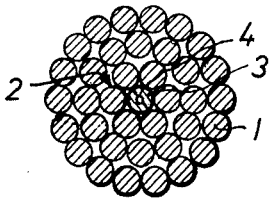
FIG. 1 is a cross-sectional view of an embodiment of an overhead transmission line with communications core according to the invention.
Figure 2:
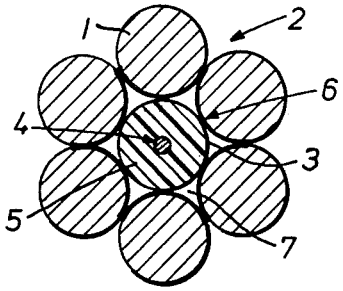
FIG. 2 is a cross-sectional detail view of the communications core of the embodiment of FIG. 1.

The overhead transmission line shown in FIGS. 1 and 2 is composed of individual wires 1 and communications core 2. Core 2 consists of an insulated coaxial line element 3 and a cage-like return conductor 6. The coaxial line element 3 itself is formed of a central conductor 4 and an insulating sheath 5 which surrounds the conductor concentrically. The sheath 5 is surrounded by the return conductor 6, which is formed from the surface sections of the adjacent individual wires 1 facing the coaxial line element 3. Wires 1 are constituted by conductors not provided with any insulation. The return conductor 6 of the communications core according to the invention thus has an approximately star-shaped cross section. The resulting dielectric constant of the all-dielectric material 5 is reduced by the presence of the filler air spaces 7.

As can be clearly seen in FIGS. 1 and 2, no special component is provided for the return conductor of the asymmetrical data communications line. The present invention therefore substantially resides in a multiple utilization of material. The central conductor 4 for the transmission of data simultaneously contributes to the transmission of power. The individual internal wires of the overhead transmission line not only transport power, they also transmit data.

Figure 3:
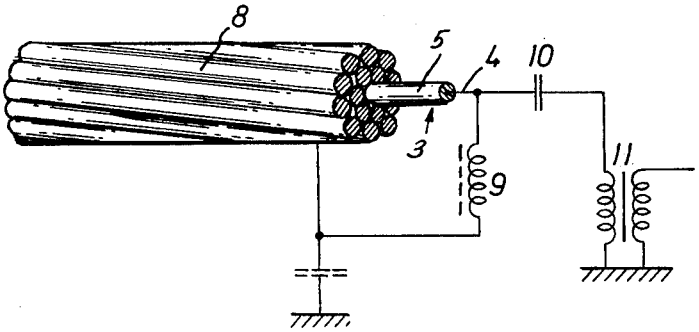
FIG. 3 is a partly-schematic, partly-pictorial, view of the connection of one end of the communications line according to the invention.

FIG. 3 shows an advantageous manner of coupling in the communications line according to the invention. The central conductor 4 of the coaxial line element 3 is here short-circuited with the solid conductors of the overhead transmission line 8 via a high frequency choke 9. The high frequency information component of the transmission is coupled out via a blocking capacitor 10 and a transformer 11, and is connected via the secondary of transformer 11 to the associated communications system.

The line shown in FIG. 3 could be constructed, according to a preferred embodiment of the invention, as a 20 kV overhead transmission line. It can consist of a central copper conductor 4 with a diameter of 0.9 mm, covered with an insulating sheath 5 of thermoplastic material like polytetrafluorethylene with a wall thickness of 1.3 mm. This core is surrounded by two layers of aluminum wires of 3.25 mm in diameter. The overall diameter amounts to 16.5 mm. The load carrying capacity of the transmission line is 430 A. The communication signal frequency band extends from 2000 Hertz to more than 120,000 Hertz.

Instead of polytetrafluorethylene the insulating sheath may also consist of other thermoplastic materials like polyethylene, crosslinked polyethylene, or other insulating materials such as ceramics, glass or others.

The overhead transmission line according to the invention can be employed as one pole, or phase line, of a single-phase or plural-phase transmission system, or as the neutral, return, or ground line of any one such system.

It will be understood that the above description of the present invention is susceptible to various modifications, changes and adaptations, and the same are intended to be comprehended within the meaning and range of equivalents of the appended claims.

What is claimed is:

1. An overhead transmission line comprising, in combination: a coaxial line element composed of a central conductor and an insulating sheath concentrically surrounding said central conductor; a plurality of power current conductors of circular cross section presenting electrically conductive surface portions and disposed around said coaxial line element in such a manner, that adjacent current conductors contact one another and said insulating sheath, the surface regions of said power conductors which face said sheath together defining a cage-like return conductor enclosing said central conductor, said coaxial line element and return conductor together defining a communications core; high frequency choke means connecting said central conductor to said power current conductors in a manner to establish a short circuit with respect to the alternating current frequency of the power to be transmitted by said current conductors; and coupling means including a blocking capacitor and a decoupling transformer connected to said central conductor for coupling said central conductor into a communications system.

2. Overhead transmission line as defined in claim 1 wherein said power current conductors contact one another to cause said return conductor to be continuous around said communications core and to have a star-shaped cross section.

3. Overhead transmission line as defined in claim 2 wherein each of said power current conductors is constituted by a bare conductive wire.

4. Overhead transmission line as defined in claim 1 wherein said coaxial line element is arranged centrally in the interior of said line in the place of a core wire.

5. Overhead transmission line as defined in claim 1 wherein said coaxial line element is arranged in the interior of said line in the place of a power current conductor.

6. Overhead transmission line as defined in claim 1 wherein said insulating sheath of said coaxial line element consists of an all-dielectric material of a synthetic thermoplastic composition.

7. Overhead transmission line as defined in claim 1 wherein said communications core is utilized simultaneously for transmitting the electrical power.

8. Overhead transmission line as defined in claim 1 and constituting one line of a plural line power transmission system.

9. An overhead transmission line comprising, in combination: a coaxial line element composed of a central conductor and an insulating sheath concentrically surrounding said central conductor; and a plurality of power current conductors of circular cross section presenting electrically conductive surface portions and disposed around said coaxial line element in such a manner that adjacent current conductors contact one another and said insulating sheath, each said power current conductor having a diameter equal to that of said coaxial line element and the surface regions of said power conductors which face said sheath together defining a cage-like return conductor enclosing said central conductor, said coaxial line element and return conductor together defining a communications core.

10. An overhead transmission line comprising, in combination: a coaxial line element composed of a central conductor, an insulating sheath concentrically surrounding said central conductor, and a conductive coating covering said insulating sheath; and a plurality of power current conductors of circular cross section presenting electrically conductive surface portions and disposed around said coaxial line element in such a manner that adjacent current conductors contact one another and said conductive coating, the surface regions of said power conductors which face said sheath together defining a cage-like return conductor enclosing said central conductor, said coaxial line element and return conductor together defining a communications core.

* * * * *